United States Patent [19]

Lindsay

[11] Patent Number: 4,825,089

[45] Date of Patent: Apr. 25, 1989

[54] RADIANT BARRIER APPARATUS

[76] Inventor: Brad H. Lindsay, 601 E. Bell Rd. Suite 350, Phoenix, Ariz. 85022

[21] Appl. No.: 72,287

[22] Filed: Jul. 13, 1987

[51] Int. Cl.[4] ..... G21F 3/02

[52] U.S. Cl. ..... 250/515.1; 250/517.1; 250/519.1; 52/404; 52/406; 350/1.7

[58] Field of Search ..... 250/515.1, 517.1; 350/1.7; 52/404, 406, 809, 743, 309.8, 309.9

[56] References Cited

U.S. PATENT DOCUMENTS

| | | | |
|---|---|---|---|
| 2,045,733 | 6/1936 | Spafford | 52/406 |
| 3,264,165 | 8/1966 | Stickel | 52/406 |
| 3,837,989 | 9/1974 | McCoy | 52/404 |
| 3,901,997 | 8/1975 | Groth | 350/1.7 |
| 4,045,931 | 9/1977 | Becker | 52/406 |
| 4,247,599 | 1/1981 | Hopper | 350/1.7 |
| 4,303,732 | 12/1981 | Torobin | 428/403 |
| 4,358,503 | 11/1982 | Homeyer | 350/1.7 |
| 4,457,966 | 7/1984 | Pusch et al. | 350/1.7 |
| 4,710,426 | 12/1987 | Stephens | 350/1.7 |
| 4,726,985 | 2/1988 | Fay et al. | 52/404 |
| 4,776,142 | 10/1988 | Hardesly | 52/404 |

*Primary Examiner*—Carolyn E. Fields
*Assistant Examiner*—John A. Miller
*Attorney, Agent, or Firm*—H. Gordon Shields

[57] ABSTRACT

Metallized film is used as a radiant barrier to prevent the transfer of heat by reflecting long wave radiation. Radiant energy apparatus includes several embodiments, including flat strips, wrinkled strips, crinkled chips, bubbles, bubbled sheets, and mesh netting with metallized layers, for different applications. Bubbled sheets and mesh netting embodiments may be used for wall installation and the like, and the other embodiments may be used for blown or loose fill insulation.

21 Claims, 3 Drawing Sheets

RADIANT BARRIER APPARATUS

BACKGROUND OF THE INVENTION

1. Field of the Invention:

This invention relates to heat barrier apparatus, and, more particularly, to radiant barriers for reflecting long wave radiation to prevent the transfer of unwanted heat.

2. Description of the Prior Art:

In contemporary usage, there are different types of insulation used to prevent the transfer of heat. In home construction, there are typically several different types of insulation used, including fiber batts, which are used in both attic and wall applications. Also included are loose fill blown insulation, which is typically ground cardboard or the like treated with borax or other fire retardants, or other types of treated particulate insulation, which are blown into attics. Similar types of insulation are also blown or inserted into the interior of brick or block walls. Sheet rock, or wall board (Gypsum) insulation is used on walls and on ceilings, with foil backed sheet rock typically used on exterior walls. Foam sheeting is typically also used on exterior walls beneath the outer facing or surface of the walls.

Insulation is generally referred to in terms of R-values, with the higher the R-value the greater the resistance to the transfer of heat. It is only the foil layer on foil-back insulation that is designed for reflecting radiant energy. Wallboard, or gypsum board, used for exterior walls generally includes a foil layer facing outwardly, toward the outside of the building, for reflecting radiant energy which penetrates the walls. Fiberglass batts may also include a foil layer for reflecting radiant energy. The other types of insulation discussed above are generally simply barriers having relatively low thermal conductivity and which accordingly simply act as retardants for the transfer of heat. However, once the heat is transferred, the same layers act as insulation for retaining the heat.

Heat, such as from the sun, is typically in the form of long wave radiation. As radiation, the radiant energy may appropriately be reflected by reflective surfaces. However, when the surfaces reflect the radiant energy, other surfaces may reflect the radiant energy back. When the radiant energy is going in different directions, it is obvious that different types of energy reflectors may be of substantial help in preventing radiant energy from penetrating where it is not wanted.

The apparatus of the present invention provides different surfaces for reflecting radiant energy. The reflective elements come in two different types, one for loose fill applications and second for layered applications. The radiant barrier apparatus of the present invention achieves a substantially increased efficiency in reflecting the long wave radiation due to the redundancy in the reflecting surfaces.

SUMMARY OF THE INVENTION

The invention described and claimed herein comprises radiant energy barriers including films metallized on both sides for reflecting long wave radiation. The metallized films include chip elements, wrinkled elements, crinkled elements, and small, sealed pillow-like bags, or "bubble-packs" filled with air or a non-toxic gas, such as argon, or the like. The bags may be manufactured side by side in rows on a single sheet or as individual bag elements.

Among the objects of the present invention are the following:

To provide new and useful radiant energy barrier apparatus;

To provide new and useful metallized elements for reflecting radiant energy;

To provide new and useful radiant energy barriers including metallized film strips;

To provide new and useful radiant energy barriers including metallized film having memory retention for retaining predetermined shapes;

To provide new and useful radiant energy barrier including metallized bags filled with a gas; and To provide new and useful radiant barrier apparatus including sheets of gaseous bags.

DESCRIPTION OF THE PREFERRED EMBODIMENT

Figure 1:
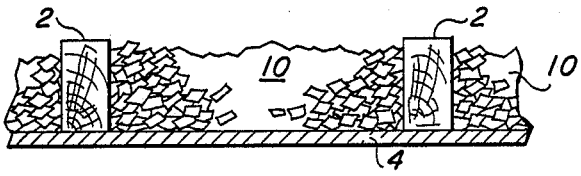
FIG. 1 is a view in partial section of one embodiment of the apparatus of the present invention in a use environment.

FIG. 1 is a view in partial section of a pair of ceiling joists 2 with a ceiling 4 of sheet rock or wall board (Gypsum) disposed beneath the ceiling joists 2. The view is through a typical attic, in which the ceiling 4 pertains to the room beneath the attic, and the ceiling joists 2 are disposed in the attic. Between the ceiling joists 2, and on top of the sheet rock, are radiant barrier elements 10 of the present invention. The radiant barrier elements 10 comprise many elements, one of which is shown in perspective in FIG. 2 and in cross section in FIG. 3. The elements 10 reflect long wave radiation in the infra red portion of the electromagnetic spectrum. A radiant barrier element 10 comprises a chip, which is generally flat and is relatively small, preferably about one inch square. However, a chip may be larger or even smaller, if desired. A plurality of the chips, in random layers, as illustrated in FIG. 1, comprise a substantial barrier to long wave infra red radiation, or heat, flowing into the attic. (Radiation in the infra red portion of the electromagnetic spectrum, or long wave infra red radiation, will simply be referred to as "long wave radiation" hereinafter.) The barrier prevents the radiant heat energy from flowing downwardly into the room beneath the ceiling 4.

Figure 3:
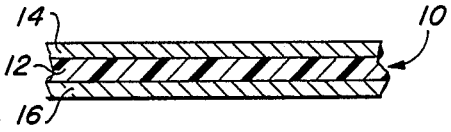
FIG. 3 is a view in partial section of a portion of the apparatus of FIG. 2.

As best illustrated in FIG. 3, each chip 10 comprises a base film substrate 12, which is preferably polyester film, or the like, coated or metallized with aluminum or similar substance on both sides. In FIG. 3, the base layer 12 is shown with a top, metallized, layer 14 and a bottom, metallized, layer 16.

The polyester film substrate 12, which actually may be of any appropriate or desired relatively thin plastic substrate, may be made in relatively large sheets and may be aluminized or metallized by well known processes prior to being cut into the individual squares or chips. If desired, the base film or substrate may also be paper, etc. The substrate, whatever it may be, includes the metallized layer on both sides to provide a radiant barrier regardless of its orientation. As shown in FIG. 1, the chips 10 are disposed in a loose fill type orientation, and they are disposed in, and consist of, many layers. The layers provide substantially continuous coverage, and with respect to the apparatus of the present invention, or to the elements of the present invention, coverage appears to be more important than a specific thickness.

Figure 2:
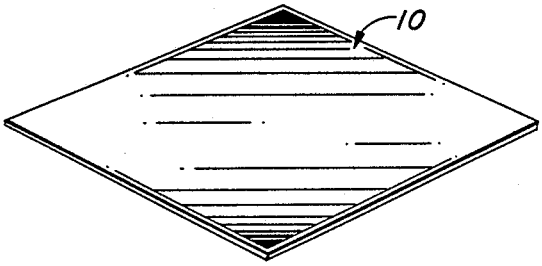
FIG. 2 is a perspective view of an element of the apparatus of the present invention.
Figure 4:
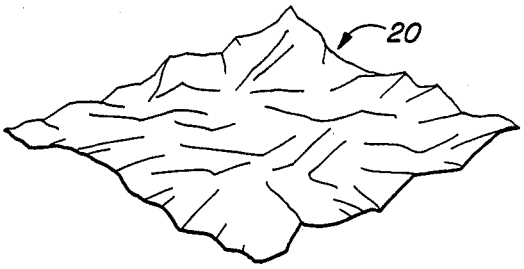
FIG. 4 is perspective view of an alternate embodiment of the apparatus of the present invention.

FIG. 4 is a perspective view of a crinkled chip 20, which comprises an alternate embodiment of the chip 10 of FIG. 2. The cross-sectional configuration of the chip 20 is substantially identical to the cross-sectional configuration of the chip 10 as illustrated in FIG. 3. However, the chip 20 is crinkled, as opposed or compared to the smooth chip 10 of FIG. 2.

The crinkling provides a separation between chips to prevent them sticking one to another, and thus enhances the coverage of the chips in a relatively uniform manner in loose fill applications.

Figure 5:
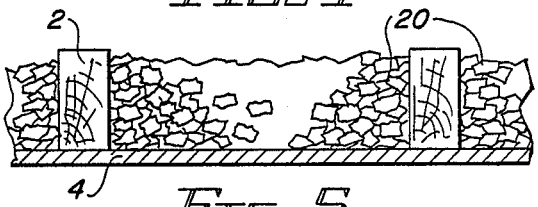
FIG. 5 is a view in partial section of the apparatus of FIG. 4 in its use environment.

In FIG. 5, layers of the crinkled chips 20 are shown disposed between the ceiling joists 2 and on top of the ceiling 4.

Figure 6:
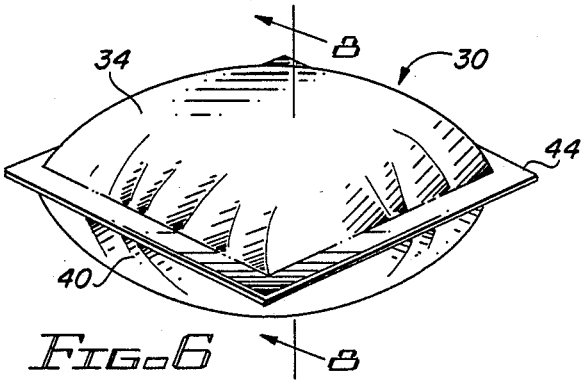
FIG. 6 is a perspective view of another alternate embodiment of the apparatus of the present invention.
Figure 8:
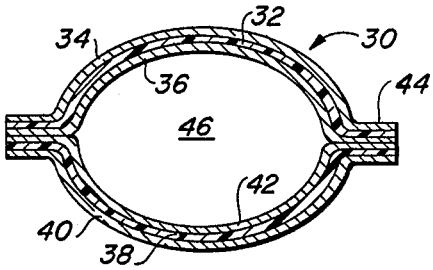
FIG. 8 is a view in partial section taken generally along line 8—8 of FIG. 6.
Figure 7:
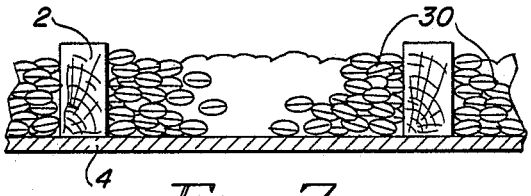
FIG. 7 is a view in partial section of the apparatus of FIG. 6 in its use environment.

FIG. 6 is a perspective view of an alternate embodiment of the element of the present invention, comprising a gaseous bag 30. FIG. 7 is a view in partial section of a portion of an attic in which a plurality of gaseous bags 30 are disposed on the ceiling 4 and between ceiling joists 2. FIG. 8 is a view in partial section through a bag 30 taken generally along line 8—8 of FIG. 6. For the following discussion of the gaseous bag 30 embodiment, reference will be directed to FIGS. 6, 7, and 8.

The gaseous bag 30 is made of two layers of a polyester film or other appropriate thin plastic substrate, aluminized or metallized on both sides, with a pair of such elements being sealed or secured together at their outer peripheries and filled with some type of gas. In FIG. 8, the gaseous bag 30 is shown made of an upper base substrate 32, with an outer aluminized or metallized layer 34 and an inner metallized or aluminized layer 36. The gaseous bag 30 also includes a lower base substrate 38 with an outer aluminized or metallized layer 40 and an inner aluminized or metallized layer 42.

The two layers 34 and 42 are secured together at a common outer periphery 44. The bag 30 includes a gas filled interior 46. The gas may be air, argon, or the like. Preferably, a substantially inert gas, such as argon is used.

The common outer periphery 44 of the layers may be appropriately secured or sealed together by any well known means. Preferably, gaseous bags may be made in large sheets of gaseous bags and cut in a grid like fashion through the middle of the sealed outer peripheries of what becomes the individual bag elements. If desired, the sheets of the bags may be used as illustrated and discussed below in conjunction with FIGS. 11, 12, and 13.

The gas-filled bags 30 include advantages not found with the chip 10, or the crinkled chip 20. The gaseous bags 30 provide substantial separation between layers, and the gas filled interior 46 introduces a captive gaseous barrier for insulation purposes. However, the aluminized or metallized layers still provide the primary radiant barrier for the reflection of long wave radiation or heat.

Figure 9:
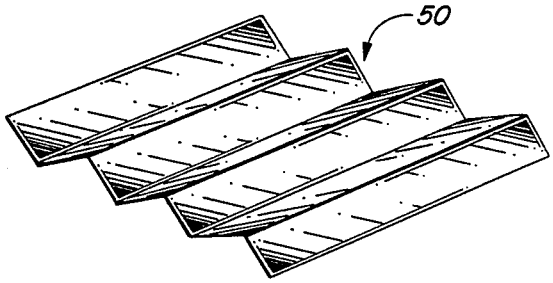
FIG. 9 is a perspective view of another alternate embodiment of the apparatus of the present invention.

FIG. 9 is a perspective view of a wrinkled wafer or fan folded chip 50, which comprises another alternate embodiment of the apparatus of the present invention. The wrinkled wafer 50 includes a base or substrate which is preferably thicker than the typical polyester film of which the wafer 10, the crinkled wafer 20, and the gaseous bag 30 is made. The reason for the thicker base film is that it must retain the wrinkled or fan folded shape illustrated in FIG. 9.

The base or substrate is metallized or aluminized on both sides, as shown in FIG. 3. After metallizing or aluminizing, the substrate or base is wrinkled, as shown in FIG. 9. Again, it is the metallized exterior which reflects long wave radiation. The reflection of the long wave radiation from the wrinkled wafer 50 may provide advantages as well as disadvantages over the chip 10, the crinkled chip 20, or the wrinkled wafer or fan folded chip 50, in loose fill applications.

Figure 10:
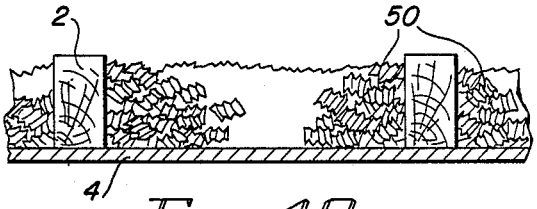
FIG. 10 is a view in partial section of the apparatus of FIG. 9 in its use environment.

In FIG. 10, a plurality of wrinkled or fan folded chips 50 is shown between the joists 2 and on the ceiling 4.

Figure 11:
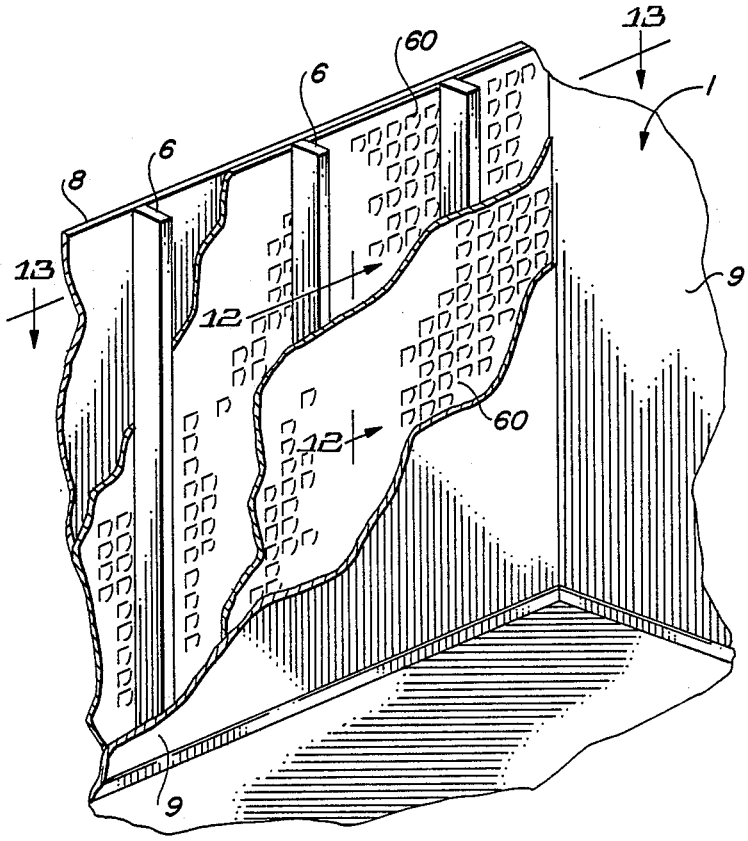
FIG. 11 is a perspective view, partially broken away, of another alternate embodiment of the apparatus of the apparatus of the present invention in its use environment.

FIG. 11 is a perspective view of a room 1 with a plurality of vertically extending wall studs 6 shown extending along a wall. The room 1 is insulated with an alternate embodiment of the apparatus of the present invention, comprising sheets of gaseous bags 60 of radiant barrier apparatus. The sheets of gaseous bags 60, which may be referred to as bubble packs, comprise sheets of gaseous bags, such as the gaseous bag 30 illustrated and discussed above in conjunction with FIGS. 6, 7, and 8.

Figure 12:
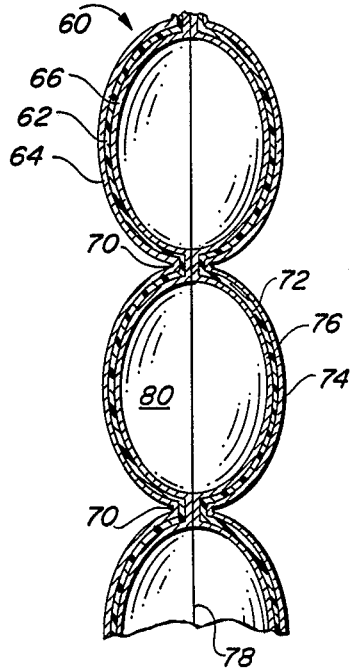
FIG. 12 is a view in partial section taken generally along line 12—12 of FIG. 11.
Figure 13:
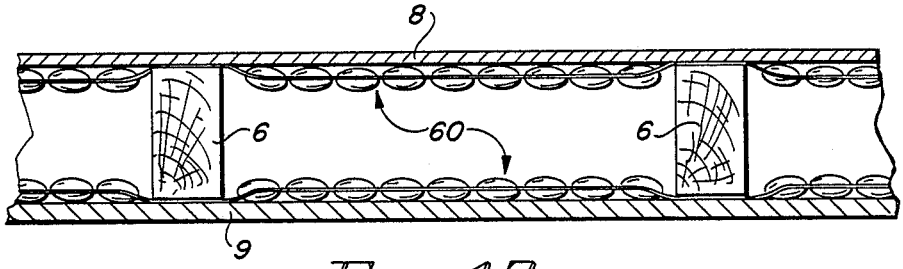
FIG. 13 is a view in partial section taken generally along line 13—13 of FIG. 11.

FIG. 12 is a view in partial section through a sheet of gaseous bags 60 taken generally along line 12—12 of FIG. 11. FIG. 13 is a view in partial section taken generally along line 13—13 of FIG. 11, schematically showing the sheets of gaseous bags 60 secured to the wall studs 6, and with sheets of wall board 8 and 9 secured to the studs over the sheets 60. In FIG. 11, parts of the wall boards 8 and 9 are broken away to show the sheets 60, and some of the sheets 60 are broken away to show the studs and the other related elements. For the following discussion of the sheets of gaseous bags 60, reference will be made to FIGS. 11, 12, and 13.

In FIG. 12, which is an enlarged view in partial section, three separate bubbles or gaseous bags are illustrated, and they are secured together. The bubble packs include a first generally continuous film layer 62 and a second generally continuous film layer 72, which are preferably polyester film or some other type of plastic film substrates.

On the film layer or substrate 62 there is an outer aluminized or metallized layer 64 and an inner aluminized or metallized layer 66. In other words, the continuous film layer 62 is metallized or aluminized on both sides. The film layer 62 comprises a substrate for the metal layers 64 and 66.

The second continuous film layer 72 is substantially identical to the film layer 62. The film layer 72 also includes an outer layer 74 and an inner layer 76. The layers 74 and 76 are, of course, metallized or aluminized layers so that the film 72, with its layers, is substantially identical to the layer 62.

The two film layers 62 and 72 are appropriately secured together in a grid type of pattern, as illustrated in FIG. 11. The layers join at horizontal connecting or lines 70 and vertical connecting lines 78. Within the grid of the connecting lines 70 and 78 are gas-filled interiors 80. The gas used to fill the interior of the bubble pack or sheet 60 may be air, argon, or some other relatively inert gas, as discussed above.

It will be noted that both sides of the base film layer in each of the above-discussed embodiments is metallized or aluminized on both sides. This insures the proper reflection of long wave radiation, even though one side may be subjected to dust, dirt, etc. Obviously, with the gas filled embodiments 30 and 60, the interior of each bubble or bag is substantially sealed so that dust, etc., cannot penetrate. Accordingly, the interior metallized layer always provides a reflective surface for the radiant energy.

Figure 14:
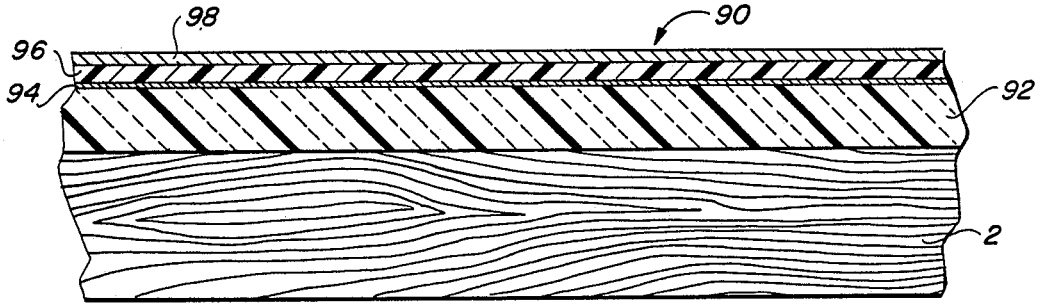
FIG. 14 is a view in partial section of another alternate embodiment of the apparatus of the present invention in its use environment.

FIG. 14 illustrates another alternate embodiment of the apparatus of the present invention in which a single metallic layer is deposited between a pair of films or film substrates. FIG. 14 comprises a view in partial section of an alternate embodiment radiant barrier apparatus 90 disposed on top of a ceiling joist 2. The alternate embodiment 90 includes a layer of expanded polystyrene foam, or the like, base 92. Appropriately bonded to the foam base 92 is a relatively thin layer or sheet 94, which may be a one-half mil polystyrene film substrate. A metallized layer 96 is appropriately secured to the film 94.

A film layer 98 is in turn disposed on the metal layer 96. The layer 98 is a relatively thick protective film layer, protecting the metallized layer 96, as well as the bottom film layer 94. The thickness of the film layer 98 may be about two mils, or about four times as thick as the layer 94. The layer 98, and also the layer 94, should both be clear film layers to insure that the metal coating layer 96, sandwiched between the two film layers 94 and 98, is highly reflective, and with relatively low emissivity, for long wave radiant energy.

It is known and understood that an aluminized layer may oxidize in time. With an aluminized layer sandwiched between two film layers, as the metal layer 96 is sandwiched between the layers 94 and 98, the likelihood of oxidation is substantially reduced due to the sandwich construction. The expanded polystyrene layer 92, or other appropriate base layer, provides the structural strength for supporting the metallized sandwich film layers and also provides additional insulation to help protect the room beneath the ceiling joist(s) 2 from the penetration of radiant heat.

The film layers 94 and 98 have been discussed as being substantially clear, and the other film layers involved, as discussed above, should similarly be substantially clear to provide for maximum reflectivity of the metallized or aluminized layers.

In place of the substrate discussed above in conjunction with the chip 10 and the crinkled chips 20, paper or the like could be used as a substrate, if desired. However, such paper substrate obviously would not be clear, but rather would be opaque.

Figure 15:
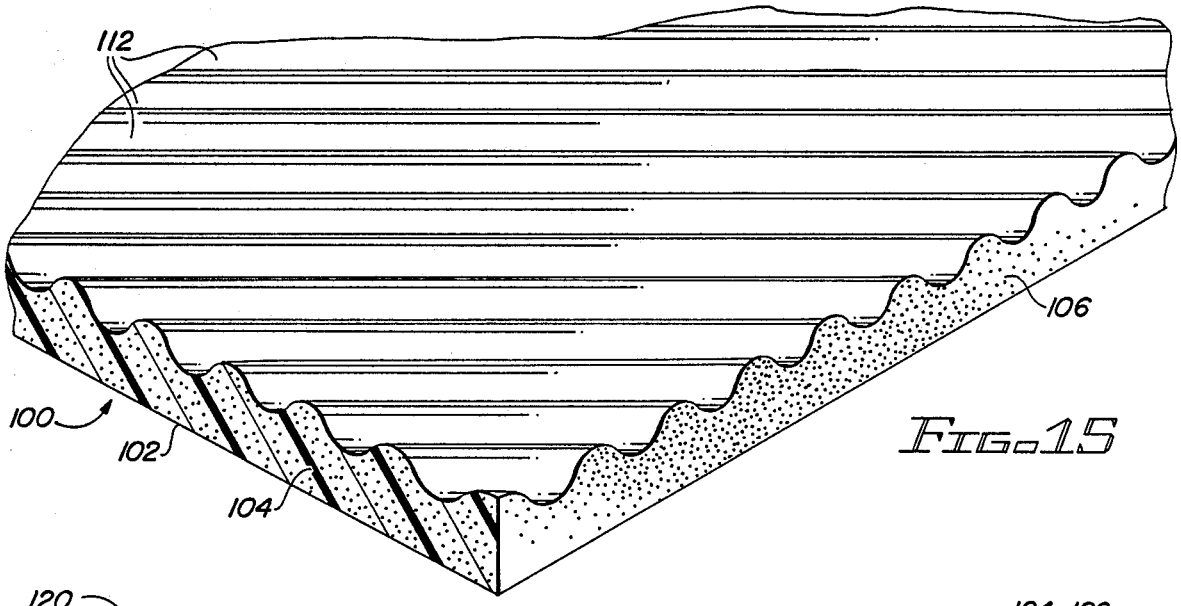
FIG. 15 is a perspective view of a portion of an alternate embodiment of the present invention.
Figure 16:
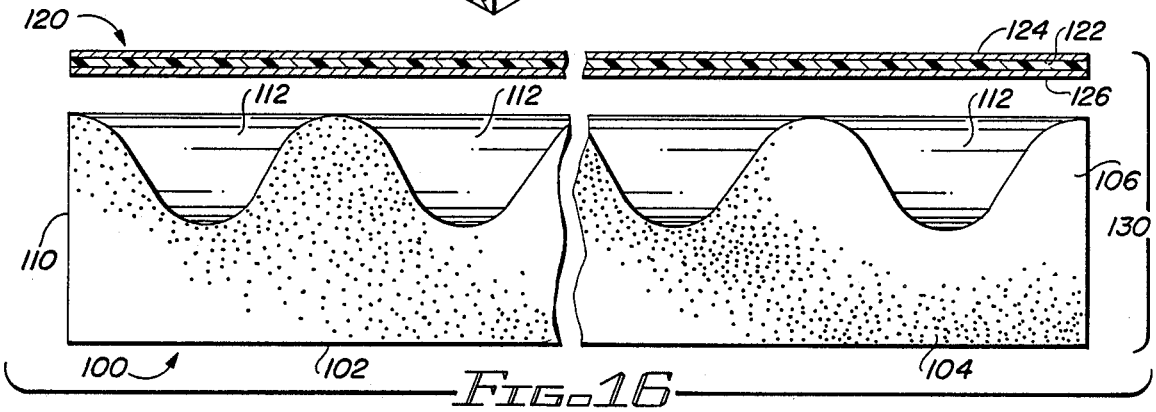
FIG. 16 is an end view of the apparatus of FIG. 15, with additional material spaced apart therefrom.
Figure 17:
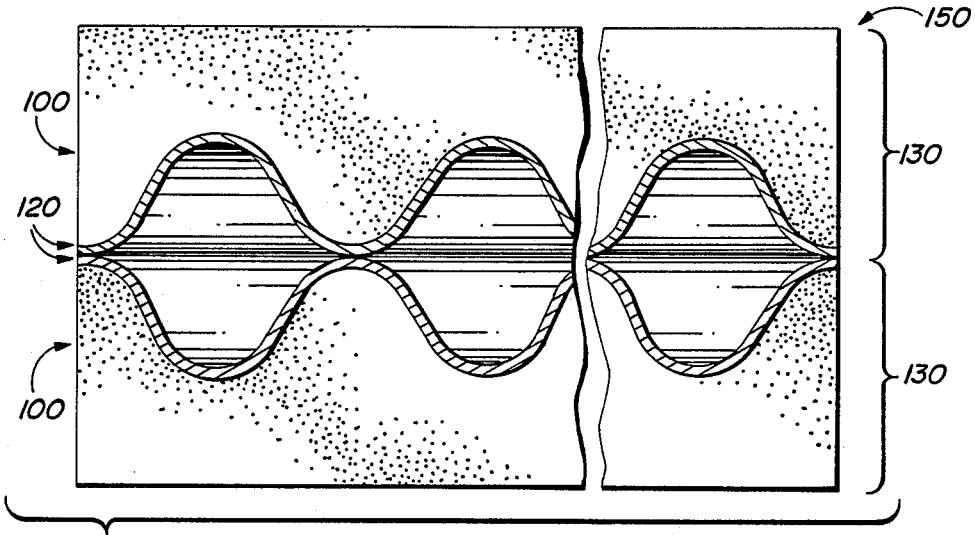
FIG. 17 is an end view of an alternate embodiment of the apparatus of the present invention, including the elements illustrated in FIGS. 15 and 16.

FIG. 15 is a perspective view of an expanded polystyrene base element 100, which is part of an alternate embodiment of the apparatus of the present invention. FIG. 16 is an end view of the base element polystyrene block 100, with a metallized film layer 120, shown in partial section, spaced apart from the block 100. FIG. 17 is an end view of an alternate embodiment 150 of the apparatus of the present invention, comprising a pair of base elements 100, with metallized film layers secured to the blocks. The top block layer is inverted and the blocks are disposed against each other and are appropriately secured together. For the following discussion of the alternate embodiment 150, reference will primarily be directed to FIGS. 15, 16, and 17.

The block 100 is preferably a generally rectangular block support layer or base having a flat bottom 102 and four relatively flat sides. The sides include a side 104 and a side 106, shown in FIG. 15, and a side 110, shown in FIG. 16, along with the side 104 and a side 106.

The top of the block 100 includes a plurality of generally parallel and diagonally extending rounded grooves 112, or a plurality of alternating convex and concave linear elements. The grooves 112 extend diagonally with respect to the four sides of the rectangular block 100. The tops of the linear elements 112 are generally parallel and are aligned with each other, and the bottoms of the grooves are at a common depth, all as best shown in FIGS. 16 and 17.

In FIG. 16, a flexible film layer 120 is shown spaced above the grooves 112 of the block 100. The film layer 120 includes a substrate 122 that is appropriately metallized on both its top side and its bottom side. The metallized layers include a top metal layer 124 and a bottom metal layer 126. The metallized layers may be any appropriate metal, as discussed above. As previously indicated, the film layer 120, with its substrate 122 and metallized layers 124 and 126, is flexible. The metallized film layer 120 is appropriately secured to the top of the block 100, or on the diagonally extending and rounded grooves 112. The completed unit comprises a radiant barrier thermal block 130.

In FIG. 17, two radiant barrier thermal blocks 130 are shown disposed against each other in a facing relationship and defining radiant barrier apparatus 150. The base block are disposed with the metallized film layers 120, on the grooves 112, facing each other. It will be understood that, because the grooves 112 are cut on a diagonal, the contact between the grooves will be in a diagonal spot-type relationship, rather than in a parallel relationship along the tops of the rounded grooves. Thus, rather than defining tubes, as would be the case if the tops of the grooves, or the lands, were in direct contact with each other, there is a series of discontinuous or separated air pockets in the center of the radiant barrier apparatus 150. It will be understood that the radiant barrier apparatus 150, in addition to comprising a radiant barrier, also comprises relatively good insulation for all types of heat transfer, rather than merely a barrier for radiant energy.

The general similarity between the component elements 130 of the barrier apparatus 150 to the radiant barrier apparatus 90 of FIG. 14 is apparent. However, the expanded foam base 92 of the radiant barrier apparatus 90 is flat on both its top and bottom sides, and accordingly, the metallized substrate is relatively flat. However, in the barrier apparatus 130, the bottom 102 is flat, but the top consists of diagonally extending gently rounded grooves, thus providing a uniformly curved surface on the top. When the metallized film or substrate layer 120 is placed thereon, the film or substrate layer takes the configuration of the grooved top and accordingly is not flat.

Figure 18:
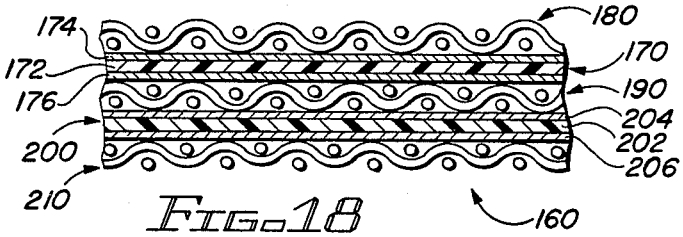
FIG. 18 is a side view in partial section of another alternate embodiment of the apparatus of the present invention.

FIG. 18 is a view in partial section of another alternate embodiment of the apparatus of the present invention, comprising a flexible radiant barrier apparatus 160. The radiant barrier apparatus 160 includes a metallized film layer 170 appropriately secured to a mesh support layer 180. The film layer 170 includes a substrate or film layer 172, with a metallized layer 174 on the top and a metallized layer 176 on the bottom of the film or substrate layer 172. The mesh layer 180 is appropriately secured to the top of the film layer 170.

A second mesh layer 190 is shown appropriately secured to the bottom of the film layer 172, or to the metal layer 176, which is the bottom metallized layer of the film substrate 172.

If desired, there could be an additional metallized film layer 200 secured to the bottom mesh layer 190. The metallized film layer 200 includes a film or substrate 202 with a top metallized layer 204 and a bottom metallized layer 206 secured thereto. The three layers comprise the metallized film layer 200.

Secured to the bottom metal layer 206 of the metallized layer 200 is another mesh layer 210.

The apparatus 160, as illustrated in FIG. 18, includes outer, or top and bottom, mesh layers 180 and 210, and a mesh layer 190 disposed between the two metallized film layers. Thus, the metallized layers 170 and 200 include mesh layers on opposite sides of them.

The mesh layers of the radiant barrier apparatus 160 provide flexibility and the support required for the barrier apparatus 160 to enable the barrier apparatus 160 to be wrapped around rounded objects, such as pipes, cylindrical water heaters, and the like. The apparatus 160 accordingly provides radiant barrier apparatus with the flexibility to conform to non linear or non flat surfaces, as desired.

The primary purpose of the mesh is to separate the radiant barrier, the metallized film, from a heat source. For example, if the apparatus 160 is used to insulate a water heater, the mesh layer against the water heater provides contact between the water heater and the metallized film layer. Similarly, if the apparatus 160 is used as a flat radiant barrier, as on a wall, an outer mesh layer separates the heat source from the radiant barrier metallized film layer.

It will be further understood that, while only two metallized layers 170 and 200 are shown in FIG. 18, there could be additional alternate layers of metallized film and support mesh to provide the desired thickness required for various applications. If desired, the outermost layer, or the layer farthest from the heat source, need not be a mesh layer, but may be a metallized film layer.

The purpose of the grooves 112 (see FIGS. 15, 16, and 17) is to prevent the film layers from touching each other over an extended area. The only contact points are at the intersections of the tops of the oppositely extending diagonal grooves (or lands). The convex outer surface configuration of the bubbles 30, or of the bubble packs or sheets 60, prevents the metallized film layers from touching each other, or prevents touching over an extended area, and prevents the metallized film layers from touching or contacting a heat source, or minimizes any such touching. The various configurations of the film layer bases, including the mesh, actually minimizes contact, if not outright preventing contact.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Radiant barrier apparatus for reflecting long wave radiation, comprising, in combination:

base means, including a flexible chip having a first substantially clear film substrate having a first side and a second side; and metallized layer means including first and second layer secured to one of each of the first and second sides of the substrate for reflecting long wave infra red radiation.

2. The apparatus of claim 1 in which the chip is crinkled and the metallized layer means comprises a first metallized layer on the first side and a second metallized layer on the second side.

3. The apparatus of claim 1 in which the chip is fan folded, and the metallized layer means comprises a first metallized layer on the first side and a second metallized layer on the second side.

4. The apparatus of claim 1 in which the chip includes a second substantially clear film substrate, and each substantially clear film substrate has a first side and a second side.

5. The apparatus of claim 4 in which the first and second substantially clear film substrates include outer peripheries, and they are sealed together at their outer peripheries to defined bag means.

6. The apparatus of claim 5 in which the bag means is filled with a gas.

7. The apparatus of claim 6 in which the metallized layer means includes the first layer secured to the first side of the first film substrate and the second layer secured to the first side of the second film substrate.

8. The apparatus of claim 7 in which metallized layer means further includes a third layer secured to the second side of the first film substrate and a fourth layer secured to the second side of the second film substrate.

9. The apparatus of claim 6 in which the bag means comprises a plurality of gas filled bags.

10. The apparatus of claim 9 in which the plurality of gas filled bags are secured together at their outer peripheries to comprise a sheet of gas filled bags.

11. The apparatus of claim 4 in which the first and second clear film substrates are secured together at a plurality of horizontal connecting lines and a plurality of vertical connecting lines to define a plurality of bags in a sheet configuration.

12. The apparatus of claim 9 in which each bag is filled with a gas.

13. The apparatus of claim 4 in which the metallized layer means is disposed between the first and second substantially clear film substrate.

14. The apparatus of claim 13 in which the first substantially clear film substrate has a first thickness, and the second substantially clear film substrate has a second thickness, and the second thickness is greater than the first thickness.

15. The apparatus of claim 13 in which the base means further includes a support base, and the first substantially clear film substrate is disposed on the support base.

16. The apparatus of claim 1 in which the base means includes a first grooved surface, and the metallized layer means includes a first metallized layer secured to the first grooved surface.

17. The apparatus of claim 16 in which the base means includes a second grooved surface, and the metallized layer means includes a second metallized layer secured to the second grooved surface.

18. The apparatus of claim 17 in which the first and second metallized layers are secured together to define a single radiant barrier block.

19. The apparatus of claim 18 in which the base means further includes a first rectangular block and a second rectangular block, and the first grooved surface extends diagonally on the first rectangular block and the second grooved surface extends diagonally on the second rectangular block.

20. The apparatus of claim 1 in which the base means includes a first mesh layer.

21. The apparatus of claim 20 in which the base means further includes a second mesh layer, and the metallized layer means is secured to the first and second mesh layers.

* * * * *